US007686711B2

(12) United States Patent
Miller

(10) Patent No.: US 7,686,711 B2
(45) Date of Patent: Mar. 30, 2010

(54) BATTING SWING AID

(75) Inventor: Ricky B. Miller, Colleyville, TX (US)

(73) Assignee: Msports LLC, Colleyville, TX (US)

( * ) Notice: Subject to any disclaimer, the term of this patent is extended or adjusted under 35 U.S.C. 154(b) by 186 days.

(21) Appl. No.: 12/008,731

(22) Filed: Jan. 14, 2008

(65) Prior Publication Data

US 2009/0181812 A1 Jul. 16, 2009

(51) Int. Cl.
*A63B 69/00* (2006.01)

(52) U.S. Cl. ..... 473/437; 473/422; 473/457

(58) Field of Classification Search ..... 473/422, 473/437, 453, 458, 519, 564
See application file for complete search history.

(56) References Cited

U.S. PATENT DOCUMENTS 5,050,877 A * 9/1991 Wales ..... 473/437
5,452,889 A * 9/1995 Lewinski et al. ..... 473/519
5,980,397 A * 11/1999 Hart et al. ..... 473/437
6,533,685 B1 * 3/2003 Otten et al. ..... 473/437
7,128,667 B2 * 10/2006 Nolan ..... 473/457
7,540,813 B2 * 6/2009 Liberatore ..... 473/457
2006/0084530 A1 * 4/2006 Cheeseman ..... 473/457

* cited by examiner

*Primary Examiner*—Mitra Aryanpour
(74) *Attorney, Agent, or Firm*—Lynn E. Barber

(57) ABSTRACT

A batting swing aid fitting onto the barrel of the bat to assist with hand speed when swinging a bat and having an outer body and an inner body. The inner body has four chamber compartments each of which is filled with an equal amount of shot. As the bat is moved to the proper hitting position the shot travels down the inside chambers to make a swoosh sound at the impact zone. During the proper swing pattern the swoosh sound will be closer and closer to the proper impact zone. The device helps build power, and repeating the swing with the additional weight increases the power of the batter and help create proper batting muscle memory.

9 Claims, 11 Drawing Sheets

BATTING SWING AID

BACKGROUND OF THE INVENTION

1. Field of the Invention

This invention relates generally to baseball and softball bats, and more specifically, relates to a swing aid added to the barrel of the bat.

2. Description of the Related Art

When people are first learning to play softball and baseball, it is difficult for them to learn to attain the correct position and speed of movement of their hands when swinging the bat to hit a ball. In baseball having the batter's hands in the appropriate position at the impact point when the bat hits the ball is critical.

Other products that have been designed for this purpose and which fit on bats only add weight to the bat for warm up, but they do not provide a way for the batter to feel the correct hand position or movement. Some of these other devices are made of metal, plastic or cloth. These products vary in weight and are used to help make the bat feel lighter after warming up.

It is therefore an object of the invention to provide a batting swing aid that allows the batter to feel the correct position, so that if the hands are in the correct position the batter will hear a loud swoosh sound when crossing the impact zone.

It is a further object of the invention to provide a batting swing aid that has a throttle designed to help slow the flow of shot down within the batting swing aid to allow for correct hand position.

It is a further object of the invention to provide a batting swing aid that improves hand position, swing speed and increase power.

Other objects and advantages will be more fully apparent from the following disclosure and appended claims.

SUMMARY OF THE INVENTION

The invention herein is a batting swing aid fitting onto the barrel of the bat to assist with hand speed when swinging a bat and having an outer body and an inner body. The inner body has four chamber compartments each of which is filled with an equal amount of shot. As the bat is moved to the proper hitting position the shot travels down the inside chambers to make a swoosh sound at the impact zone. During the proper swing pattern the swoosh sound will be closer and closer to the proper impact zone. The device helps build power, and repeating the swing with the additional weight increases the power of the batter and help create proper batting muscle memory.

Other objects and features of the inventions will be more fully apparent from the following disclosure and appended claims.

DETAILED DESCRIPTION OF THE INVENTION AND PREFERRED EMBODIMENTS THEREOF

The present invention is a batting swing aid for baseball and softball that fits onto the barrel of a bat and has been designed to assist with hand speed when swinging a bat. The batting swing aid of the invention has a unique chamber design, a throttle for timing of dispersing shot, an inner and outer configuration, and durable construction. The two piece construction of the batting swing aid of the invention allows the centrifugal force to help keep the unit solid on the bat. While swinging the unit, the force is thrown toward the thick end of the bat thus securing the unit to the bat. These characteristics of the invention make it unique and different from any other baseball swing device. The batting swing aid helps hand speed, hand positioning at impact and bat extension, while helping to build power and muscle memory.

Thus, the batting swing aid of the invention comprises:

a) a hollow tapered cylindrical outer body having a proximal end and a distal end, the proximal end narrower than the distal end, the tapered outer body surrounding an inner cavity and having at least four equally spaced ribs positioned inside the outer body and extending lengthwise on the outer body and protruding into the inner cavity;

b) a hollow inner body having a tapered proximal end and a distal cylindrical end and having equal-sized distal shot compartments within the distal cylindrical end;

wherein the proximal end of the inner body has grooves extending lengthwise on the outside of the proximal end, the proximal end of the inner body has an external size so that when the tapered proximal end of the inner body is placed inside the inner cavity of the tapered outer body, the ribs on the outer body fit closely within the grooves on the inner body, forming body chambers that are aligned with the shot compartments, and the inner body has an internal size that fits over a bat handle;

wherein the distal cylindrical end of the inner body proximally abuts the distal end of the outer body; and wherein the batting swing aid further comprises shot positioned in the aligned shot compartments and body chambers and that is capable of moving within the aligned shot compartments and body chambers when the batting swing aid is moved.

Figure 2:
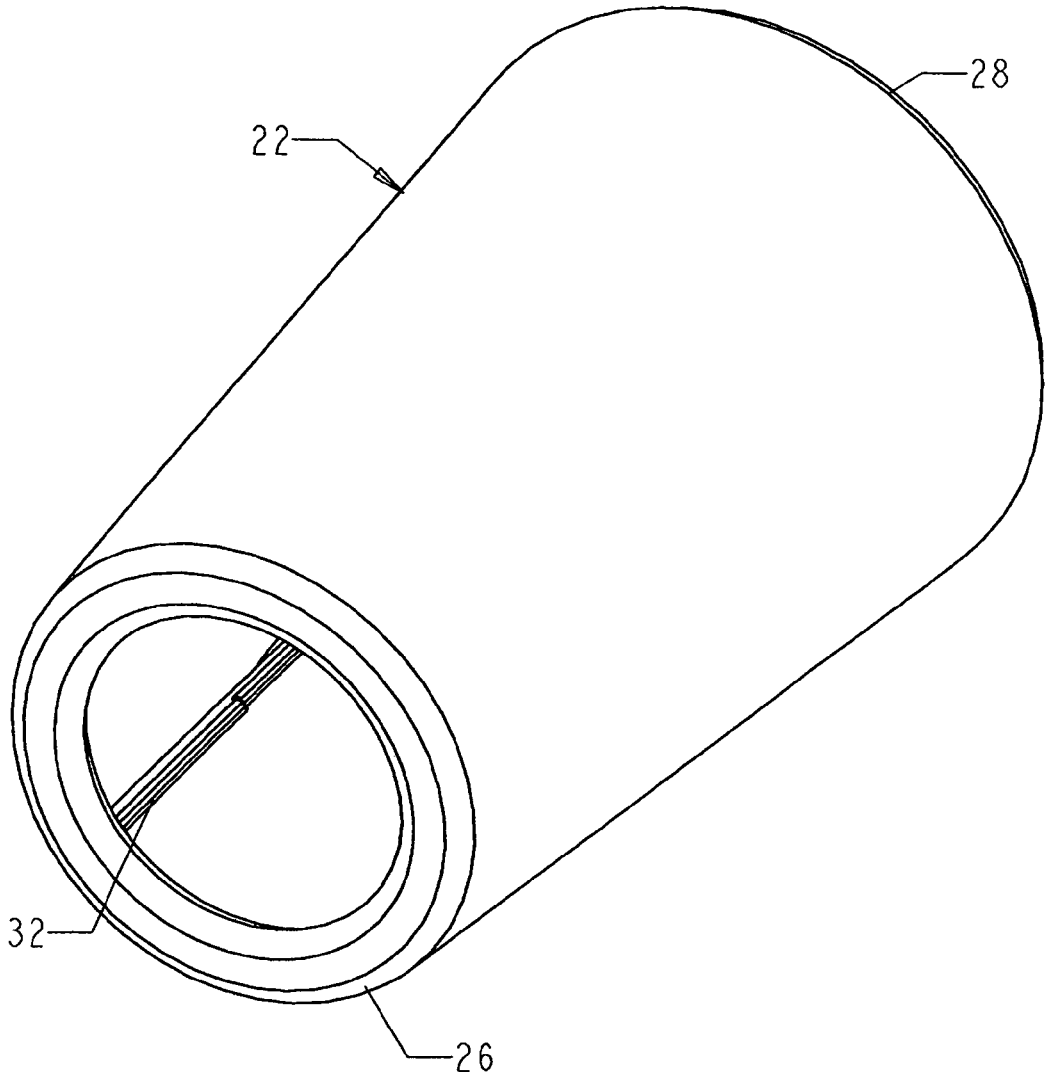
FIG. 2 is a side perspective view of the outer body.
Figure 3:
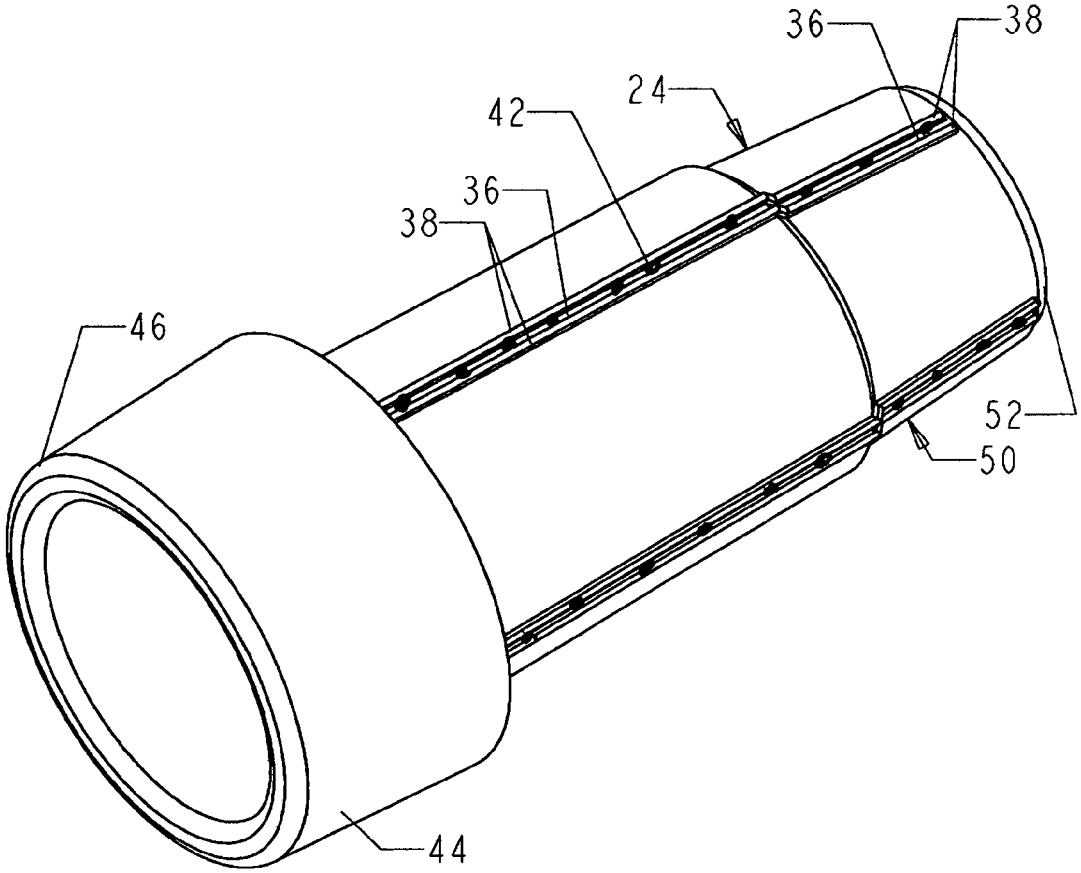
FIG. 3 is a side perspective view of the inner body of the invention.
Figure 4:
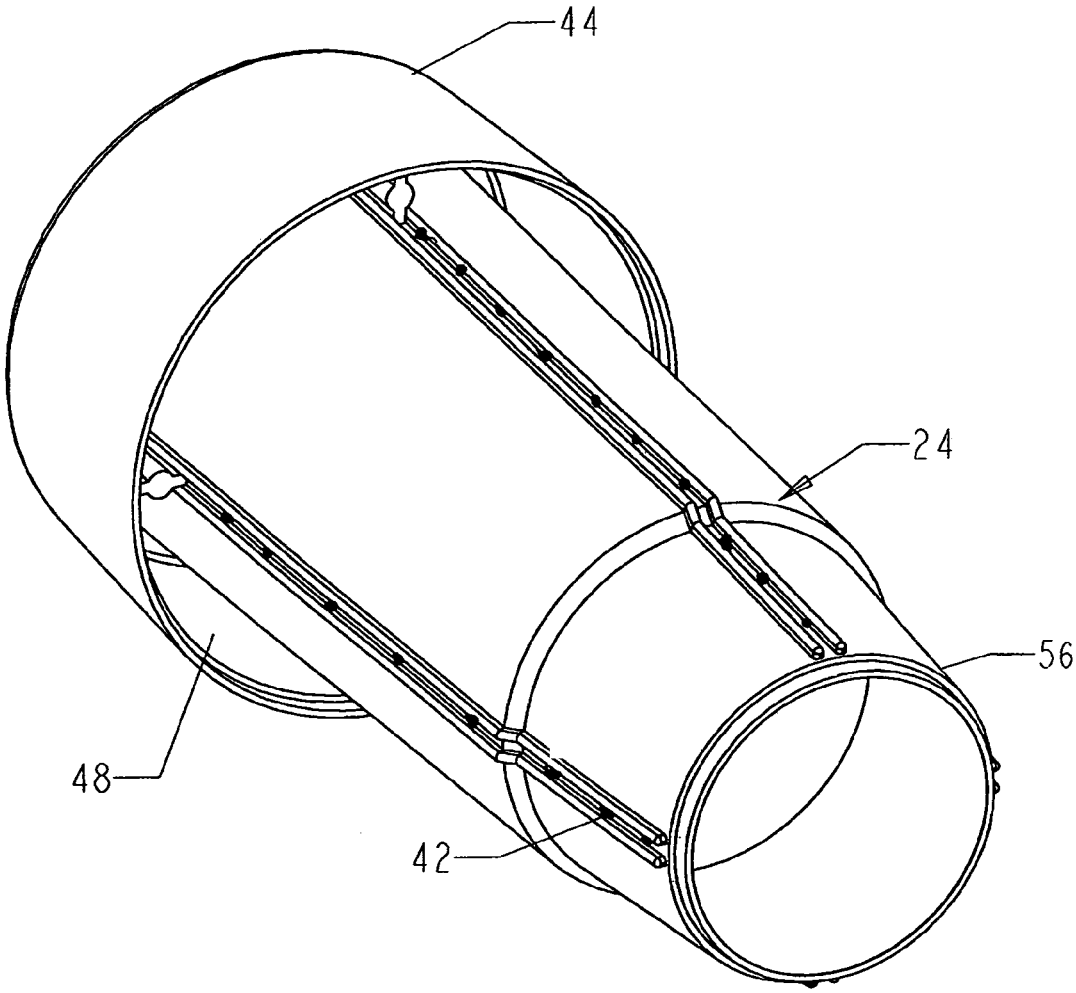
FIG. 4 is another perspective view of the inner body of the invention showing the compartments where the shot is located on the inner body.

Referring now to the figures, the assembled batting swing aid 20 of the invention (FIGS. 7-11) consists of a two piece structure, an outer body 22 (FIGS. 1 and 2) and an inner body 24 (FIGS. 3-4). The assembled batting swing aid 20 has an interior taper so that it can be made to fit snugly on a variety of sizes of softball and baseball bats. In addition, the outer shape of the batting swing aid 20 is preferably also tapered at its proximal end 26 (toward the batter's hands) to allow for smoother performance and to reduce the weight of the batting swing aid 20.

Figure 1:
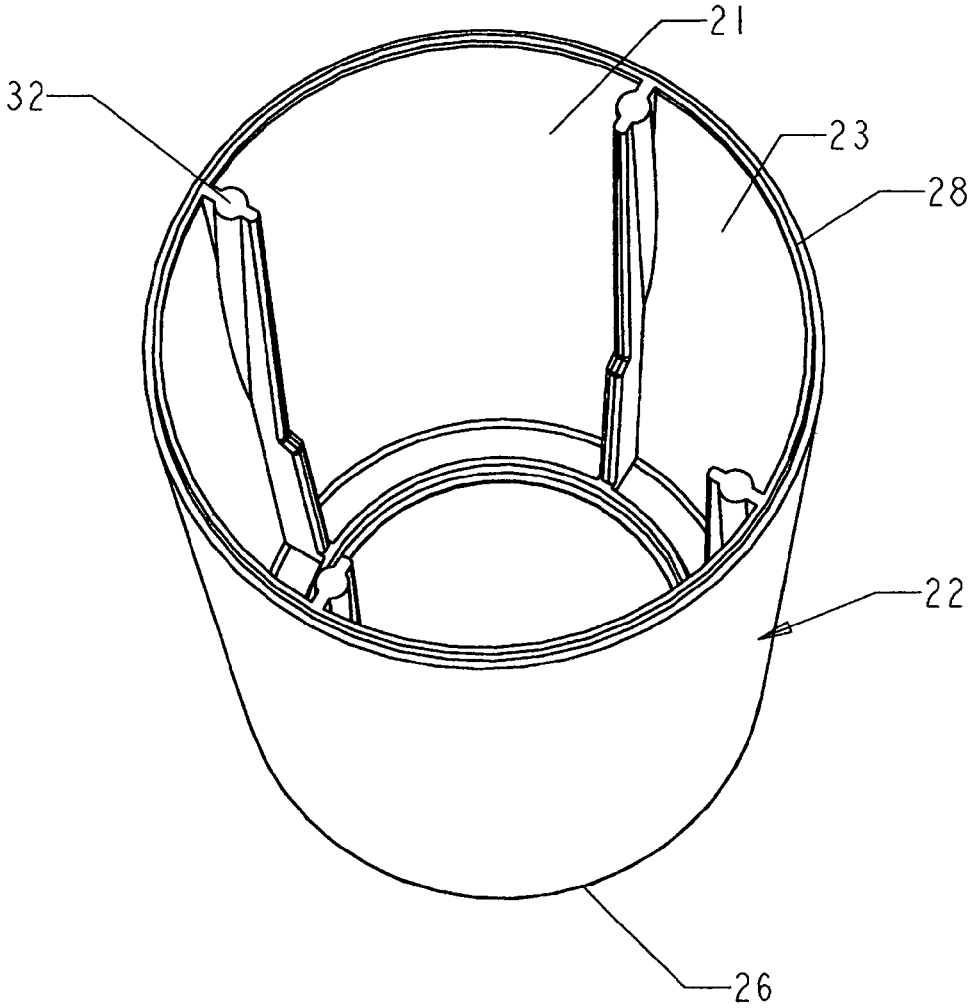
FIG. 1 is a top view of the outer body compartment of the batting swing aid of the invention.
Figure 10:
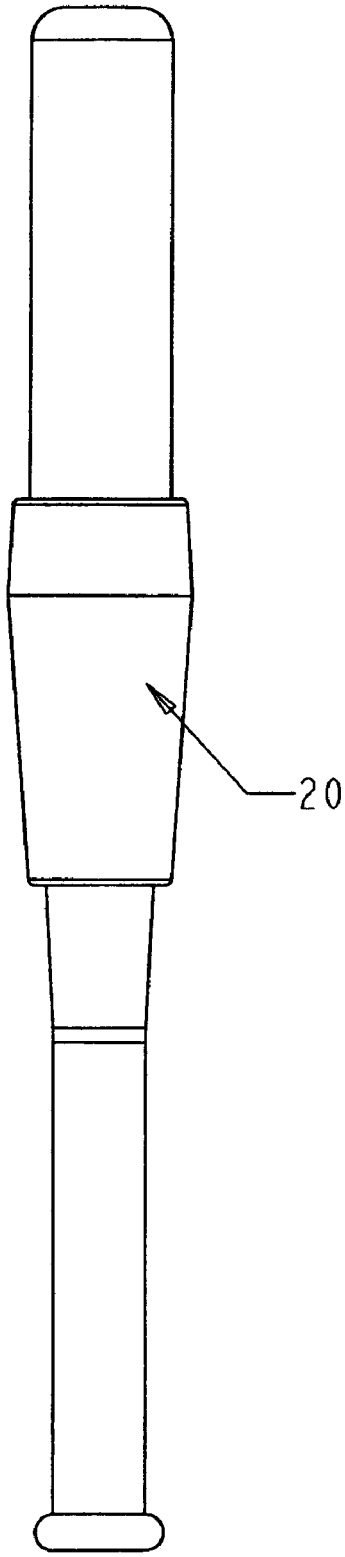
FIG. 10 is a perspective view of the batting aid of the invention in proper position on a bat for use in batter.
Figure 11:
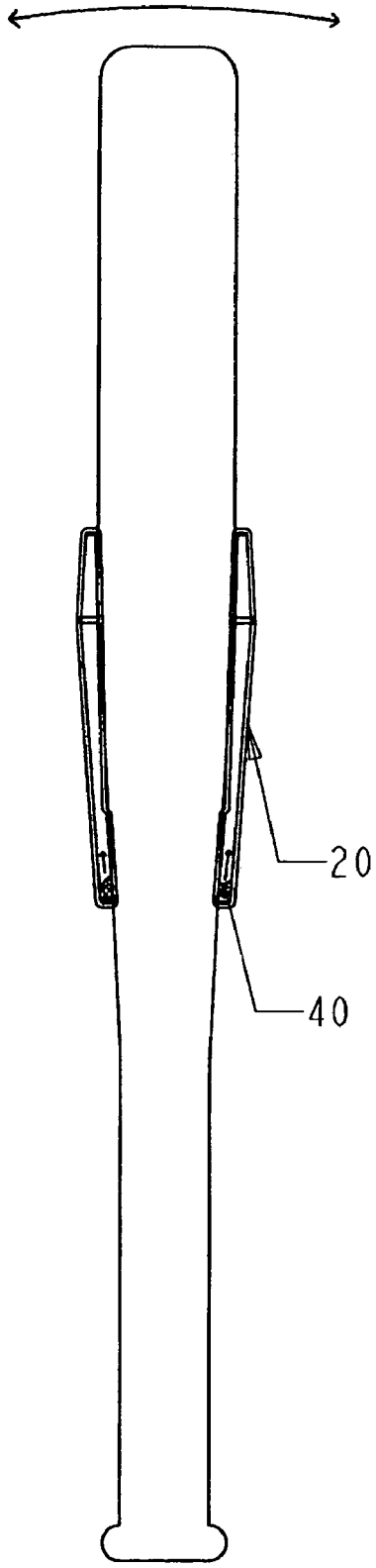
FIG. 11 is a cross-sectional view of an assembled batting aid of the invention on a bat, showing the position of the shot within the batting aid.

The hollow outer body 22 is externally cup-shaped with a gentle taper to decrease both the exterior and interior diameter from the distal end 28 to the proximal end. The walls 23 of the outer body 22 surround an inner cavity 21. The narrower proximal end 26 of the outer body 22 is located toward the handle of the bat in use, while the wider opening at the distal end 28 is located toward the barrel of the bat, more distal from the batter as shown in FIGS. 10-11. It is the wider area that is placed over the handle first when the batting swing aid 20 is placed on the bat handle. At the narrower proximal end 26, the walls 23 of the outer body 22 are reinforced by being thicker with the internal taper of the assembled unit providing for a thicker wall at this end (FIGS. 1-2). This is the area of the outer body 22 that hits the ground when the batting swing aid 20 is removed from the bat.

FIG. 1 shows the outer body 22 with four equally spaced interior ribs 32 extending lengthwise on the inside of the outer body 22 to provide equal dispersion of the inserted weights (preferably shot 40 such as BB's, shown in FIG. 11). Preferably there are four such ribs 32, but there may be more so long as they are equally placed inside the walls 21. FIG. 2 shows a side view of the outer body 22. These ribs 32 on the outer body 22 are designed to fit in the inner body 24 for compartmentalized design. The rib configuration is also designed to help strengthen the bond between the inner and outer body. The length of the outer body 22 is preferably 8 inches with a tapered configuration as shown in FIG. 2 so that in the preferred embodiment the distal end 28 is 3 inches wide on the inside.

The inner body 24 (FIGS. 3-4) is also hollow with a hollow tapered proximal end 52 and a hollow cylindrical distal end 46. The inner body 24 has lengthwise extending grooves 36 on the outside of the inner body 24 into which fit the ribs 32 of the outer body 22. Inner body also preferably has sets of dual ribs 38, each of which sets of dual ribs 38 has a groove 36 between them in which the single rib 32 of the outer body slides. The dual ribs 38, grooves 36 and ribs 32 in the assembled batting swing aid compartmentalize the area between the assembled inner body 24 and outer body 22 forming body chambers 58 (FIG. 5), and reinforce the strength of the assembled batting swing aid 20. While there could be a different number of ribs than four, preferably there are four ribs.

At the areas where the grooves and ribs fit together is where glue 42 is preferably placed for welding the inner body 24 and the outer body 26 together to form the batting swing aid 22 after shot 40 has been added to the chamber as discussed below (FIG. 11). Preferably the glue which bonds the batting together is a solvent bond, UV cure adhesive, ultrasonic weld bonding the outer and inner bodies together, such as Loctite 4205, which is a Thermal Resistant Gel.

The inner body 24 has a compartment 44 located at the distal end 46 of the inner body 24 for the shot to be placed in as the batting swing aid is being assembled. In this area the walls are preferably slightly thicker than on the rest of the inner body (FIG. 3, at distal end of inner body). This compartment 44 is also divided into four chamber areas 48 (FIG. 4) to keep shot separated evenly around the circumference of the batting swing aid 20. Each of the four chamber areas 48 is filled with the equal amount of shot 40.

The preferred shot is magnum shot no. 7.5. With a batting swing aid having an inner body 24 of 4.3 oz and an outer body 22 of 3.3 oz, the total weight of the batting swing aid, including shot, preferably varies from a small unit of 12 oz, a somewhat larger unit of 16 oz., a larger unit of 20 oz., and the largest unit of 24 oz., however, any comparable weight may be used as desired.

As shown in FIGS. 3 and 4, the throttle zone 50 formed by the reduced diameter of the inner body 24 of the invention is located at the narrower proximal end 52 of the inner body 24 when assembled to the outer body 22, with the purpose of this zone 50 being to slow the flow of shot down the batting swing aid 20 for proper hand positioning at the ball impact zone. The ribs 32 extend within the throttle zone 50 on the outer body 22 and join in the assembled batting aid with corresponding dual ribs 38 and grooves 36 on the inner body 24. When the batting swing aid 20 is assembled with the inner body 24 inside the outer body 22 and shot 40 located in the shot compartments 44, shot is first located in the throttle zone 50 when the batter's swing is first started (see FIG. 11 for shot position).

Preferably the outer and inner bodies 22, 24 of the batting swing aid 20 of the invention are made of a clear or translucent impact plastic material as known in the art, and preferably the material is selected from the group consisting of Polycarbonate, K-Resin, Clarified polypropylene, impact acrylic and the like.

When made of the preferred material, the weight of the outer body is preferably about 100 grams or 3.53 ounces and the weight of the inner body is preferably about 130 grams or 4.59 ounces, so that the total weight of both the inner and outer bodies is 230 grams or 8.11 ounces. The shot is added to this amount to bring it up to various levels depending on the requested weight needed. The older batters can require more shot to increase the weight per batting swing aid.

Figure 7:
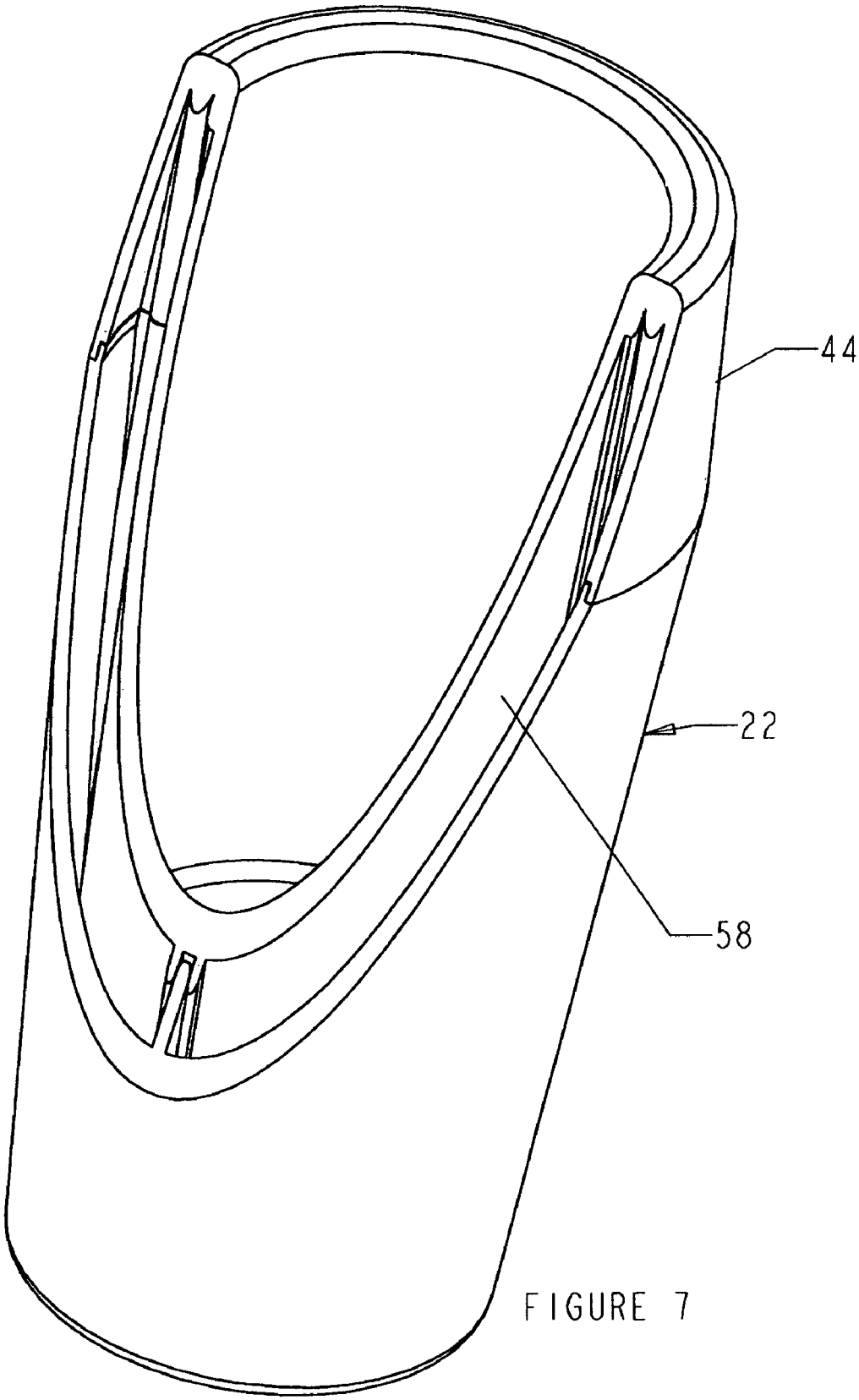
FIG. 7 shows a cut away of the complete assembled batting swing aid unit.
Figure 8:
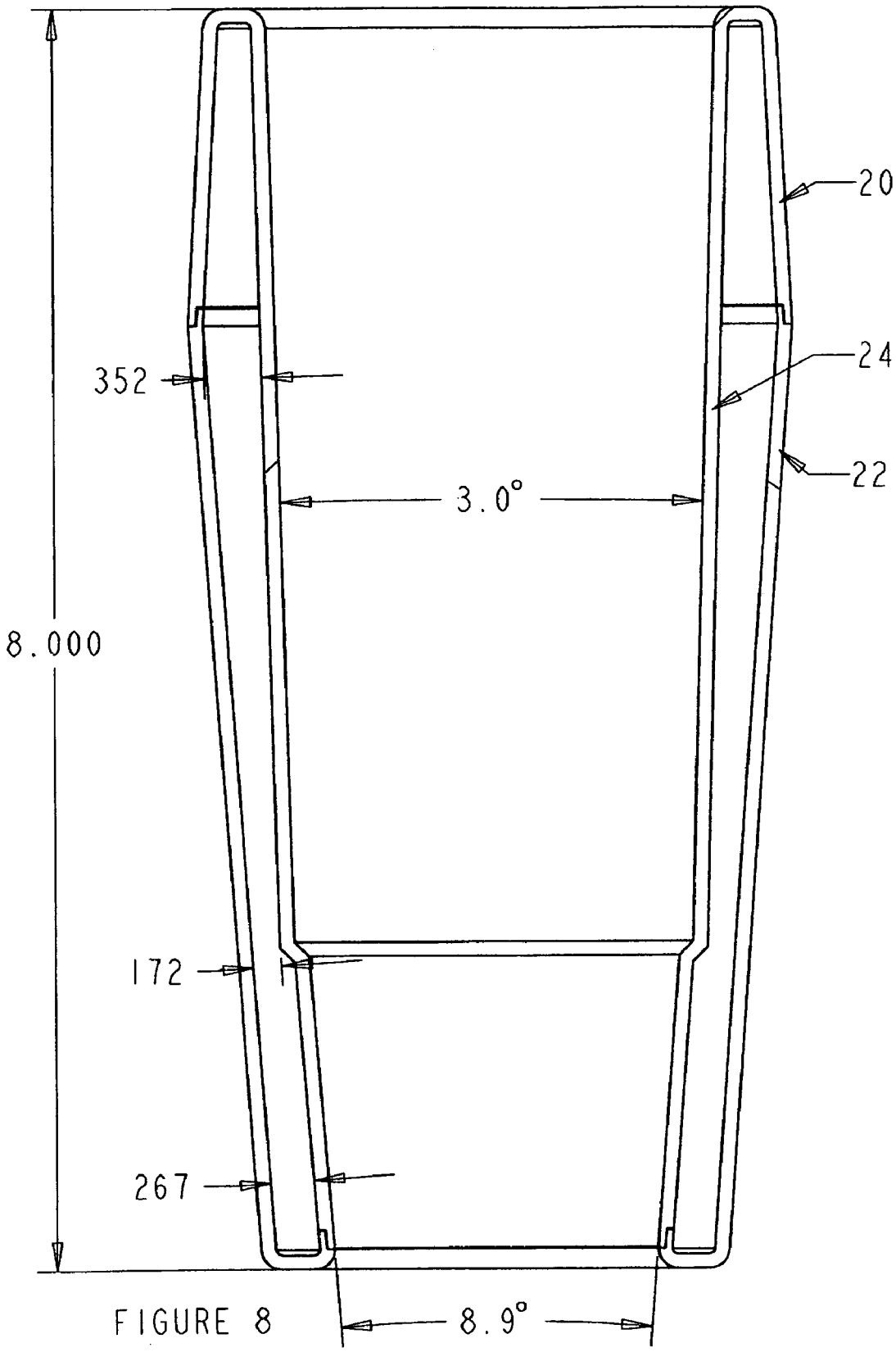
FIG. 8 is a side-cross-sectional view of the assembled batting swing aid unit showing preferred dimensions.
Figure 9:
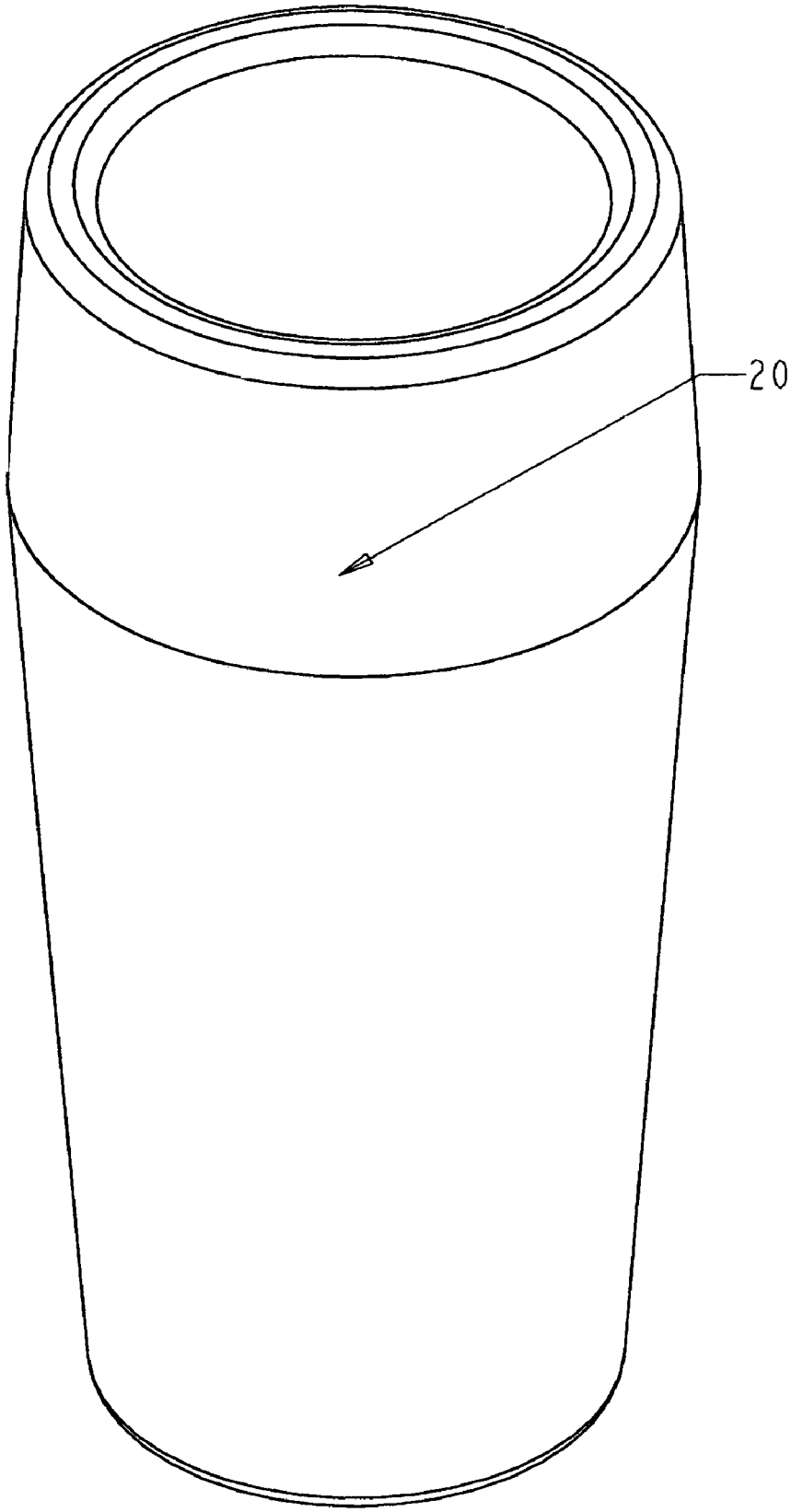
FIG. 9 is a perspective side view of the complete assembled batting swing aid unit.

When the batting swing aid 20 is assembled as shown in FIGS. 7-8, the internal taper from distal to proximal end is preferably about 3 degrees with the interior diameter decreasing evenly until the throttle zone, and then there is an abrupt decrease in interior diameter as shown, followed by a taper of preferably about 9 degrees to the proximal end.

Figure 5:
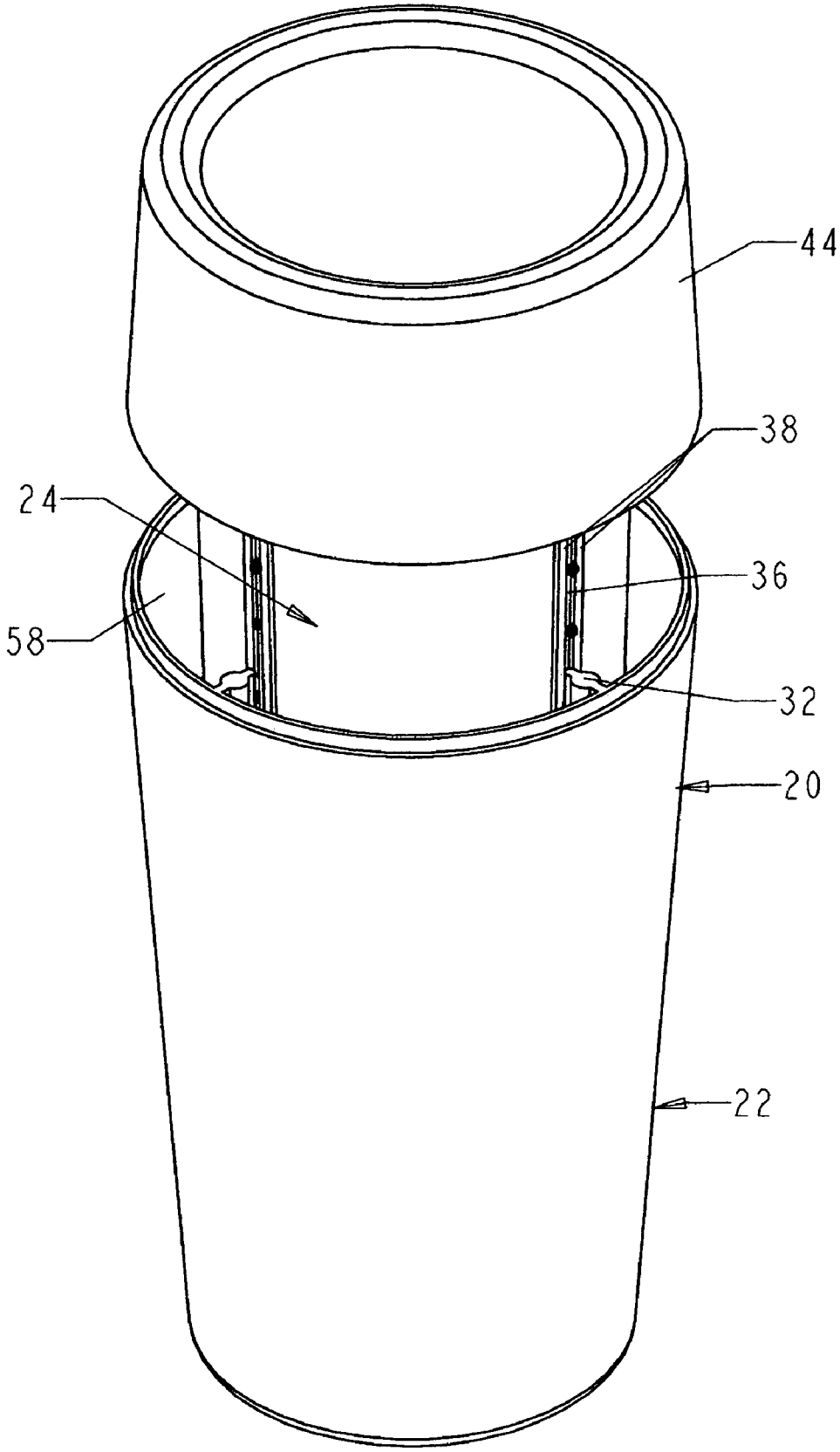
FIG. 5 is a side perspective view showing how the inner and outer bodies slide together for strength and hold shot in chambers for equal weight dispersion.
Figure 6:
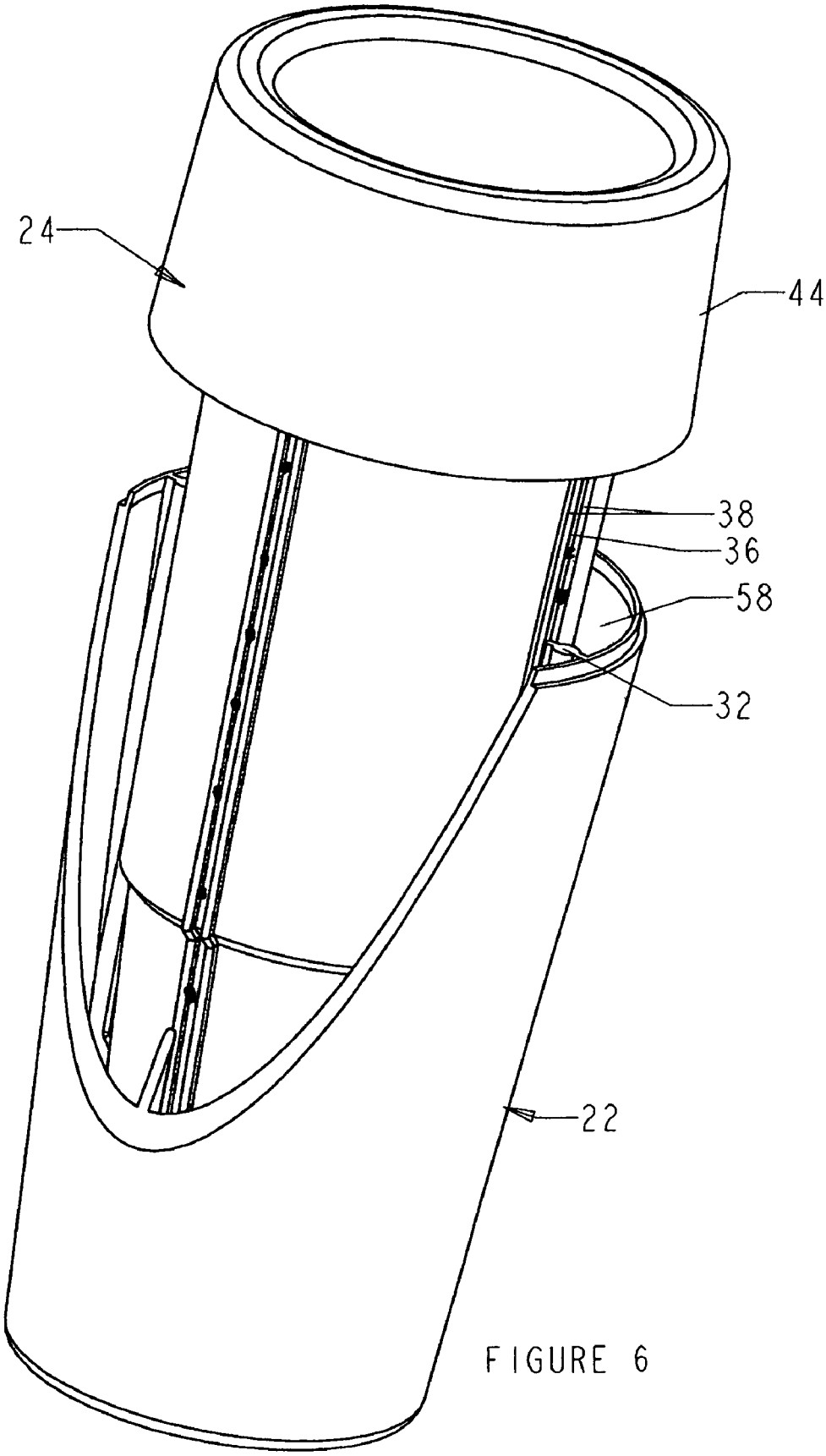
FIG. 6 shows a cut away of the inner and outer bodies where the two bodies are not fully assembled together.

The device fits together and when assembled is thus comprised of four separate, equal-sized body chambers 58, which allow the shot to travel down when the bat is moved forward to the proper hitting position. FIG. 5 shows how the outer and inner bodies 22, 24 of the batting swing aid 20 slide together for strength and to make chambers to hold shot in chambers for equal weight dispersal. FIG. 6 shows a cut away of the outer and inner bodies 22, 24 where the two bodies are not fully assembled together, and FIG. 7 shows a cut away of the complete assembled batting swing aid. In each figure, the presence of body chambers 58 between the outer and inner bodies is evident. As can also be seen from the figures, the distal cylindrical end of the inner body proximally (toward the batter's hands) abuts the distal end of the outer body.

This batting swing aid 20 also adds weight to the bat allowing for a warm up situation during on deck practice. As the bat is moved to the proper hitting position the shot travels down the inside chambers to make a swoosh sound at the impact zone. During the proper swing pattern the swoosh sound will be closer and closer to the proper impact zone. The device helps build power, repeating the swing with the additional weight will increase the power of the batter and help create proper batting muscle memory.

The baseball batting training device is designed to teach the proper hitting technique and hand position during the impact point of the swing. Once the device is placed on the barrel of the bat and the hands are at the top of the swing in the proper position the shot is located in the base of the chamber. As the swing is started the shot moves within the chamber to the end of the batting aid. The training aid allows the batter to feel the power as well as hear the shot reaching the end of the device and reaching the impact zone.

The batting swing aid's tapered inside design fits on all sizes of bats. In use, the aid is positioned over the bat handle with the wider end going over the handle first. From the handle of a bat to the barrel, the interior diameter of the inner body is tapered such that it grips to the larger part of the bat once placed over the handle as shown in FIGS. 10-11. The batting swing aid falls down onto the barrel of the bat when the bat is held handle uppermost, the batting aid becomes secured to the barrel. To release the aid from the handle of the bat, one simply hits the handle on the ground and the batting aid falls off the bat.

The reinforced throttle area 50 (FIG. 3) has been reinforced with a thicker outer wall 56 for increased durability. This area is designed to make the batter get his or her hands set at the top of the swing zone. It slow the shot from rushing back down toward the handle. It also helps to slow the shot down when leaving the chamber on the swing. Once the batting swing aid is taken off the bat, it is ready to be used by the next batter.

The overall design of the batting swing aid is to provide both baseball and softball players a training aid which will help them develop batting power, swing speed, hand positioning, and proper feel of bat positioning at impact. Other further features and advantages of the present invention will be readily apparent to those killed in the art upon reading of the following disclosure when taken in conjunction with the accompanying drawings.

While the invention has been described with reference to specific embodiments, it will be appreciated that numerous variations, modifications, and embodiments are possible, and accordingly, all such variations, modifications, and embodiments are to be regarded as being within the spirit and scope of the invention.

What is claimed is:

1. A batting swing aid, comprising:

a) a hollow tapered cylindrical outer body having a proximal end and a distal end, the proximal end narrower than the distal end, the tapered outer body surrounding an inner cavity and having at least four equally spaced ribs positioned inside the outer body and extending lengthwise on the outer body and protruding into the inner cavity;

b) a hollow inner body having a tapered proximal end and a distal cylindrical end and having equal-sized distal shot compartments within the distal cylindrical end;

wherein the proximal end of the inner body has at least four grooves extending lengthwise on the outside of the proximal end, the proximal end of the inner body has an external size so that when the tapered proximal end of the inner body is placed inside the inner cavity of the tapered outer body, the ribs on the outer body fit closely within the grooves on the inner body, forming body chambers that are aligned with the shot compartments, and the inner body has an internal size that fits over a bat handle;

wherein the distal cylindrical end of the inner body proximally abuts the distal end of the outer body; and wherein the batting swing aid further comprises shot positioned in the aligned shot compartments and body chambers and that is capable of moving within the aligned shot compartments and body chambers when the batting swing aid is moved.

2. The batting swing aid of claim 1, wherein the body chambers comprise a proximal throttle zone.

3. The batting swing aid of claim 1, wherein there are four body chambers.

4. The batting swing aid of claim 1, wherein when hands of a batter are placed on a bat upon which the batting aid is positioned and the shot is positioned in the body chambers, when the batter begins to swing, shot moves from the proximal end of the body chambers and down the body chambers making a swooshing sound while going through an impact zone.

5. The batting swing aid of claim 1, wherein the outer and inner bodies are made of a clear or translucent impact plastic material selected from the group consisting of Polycarbonate, K-Resin, Clarified polypropylene, and impact acrylic.

6. The batting swing aid of claim 1, wherein the distal cylinder end of the inner body has a thickened wall allowing for more durable impact area for releasing the batting aid from the bat.

7. The batting swing aid of claim 1, wherein the ribs of the outer body are glued together with corresponding grooves of the inner body.

8. The batting swing aid of claim 1, further comprising ribs adjacent to and on each side of the grooves on the inner body.

9. The batting swing aid of claim 1, further comprising a glue which bonds the batting swing aid together and is a solvent bond, UV cure adhesive, ultrasonic weld bonding the outer body and inner body units together.

* * * * *